US007628717B2

(12) United States Patent
Purcell et al.

(10) Patent No.: US 7,628,717 B2
(45) Date of Patent: Dec. 8, 2009

(54) VERTICALLY ADJUSTABLE BACKBOARD

(75) Inventors: Maurice A. Purcell, Greenville, SC (US); Dan D. Shaw, Pleasant Grove, UT (US); Thomas Leslie Hilton, Greenville, SC (US)

(73) Assignee: Gym Dynamics, LLC, Liberty, SC (US)

( * ) Notice: Subject to any disclaimer, the term of this patent is extended or adjusted under 35 U.S.C. 154(b) by 244 days.

(21) Appl. No.: 11/893,322

(22) Filed: Aug. 15, 2007

(65) Prior Publication Data

US 2009/0048041 A1 Feb. 19, 2009

(51) Int. Cl.
*A63B 63/08* (2006.01)

(52) U.S. Cl. ..... 473/483; 473/479

(58) Field of Classification Search ..... 473/479, 473/481, 482, 483, 484, 476, 415; 49/200, 49/139, 99

See application file for complete search history.

(56) References Cited

U.S. PATENT DOCUMENTS

| | | | | | |
|---|---|---|---|---|---|
| 13,435 | A | * | 8/1855 | Payne | 49/99 |
| 2,916,288 | A | | 12/1959 | Chervenka | |
| 3,412,423 | A | * | 11/1968 | Binns | 16/198 |
| 4,465,277 | A | | 8/1984 | Dittrich | 273/1.5 |
| 4,643,422 | A | | 2/1987 | Cramblett | 273/1 |
| 4,731,905 | A | * | 3/1988 | Milano et al. | 16/306 |
| 4,781,375 | A | | 11/1988 | Nye | 273/15 R |
| 4,948,127 | A | | 8/1990 | Willard | 273/1.5 R |
| 5,102,127 | A | * | 4/1992 | Pohrer | 473/483 |
| 5,279,496 | A | | 1/1994 | Schroeder | 273/1.5 R |
| 5,671,500 | A | * | 9/1997 | Balk | 16/72 |
| 5,800,296 | A | | 9/1998 | Shaw | 473/483 |
| 5,947,849 | A | | 9/1999 | Ellenbaum | 473/483 |
| 6,056,654 | A | * | 5/2000 | Schroeder | 473/483 |
| 6,537,162 | B1 | * | 3/2003 | Schroeder | 473/483 |
| RE39,504 | E | | 3/2007 | Scates et al. | 49/200 |
| 7,306,530 | B2 | * | 12/2007 | Connerley | 473/483 |

* cited by examiner

*Primary Examiner*—Gene Kim
*Assistant Examiner*—M Chambers
(74) *Attorney, Agent, or Firm*—Joseph T. Guy; Nexsen Pruet, LLC

(57) ABSTRACT

A vertically adjustable backboard support includes a fixed position structure to which a shiftable backboard structure is sliding attached for vertical adjustment between several selectable elevations. A torsion spring counterbalance apparatus on the fixed position structure facilitates manual shifting of the adjustable backboard structure to any of its vertically adjusted positions. A vertically disposed outer tube of the fixed position structure includes vertically spaced openings in one of its side walls for receiving a cam secured to a vertical operating rod rotatably mounted to the shiftable backboard structure for selecting and maintaining desired vertical positions of backboard adjustment.

16 Claims, 10 Drawing Sheets

VERTICALLY ADJUSTABLE BACKBOARD

BACKGROUND OF THE INVENTION

Vertically adjustable basketball backboards facilitate use of a basketball court by different age groups. The support for the backboard and rim needs to be structurally sound because of the tendency of players to hang on the rim during a slam dunk. Slide mechanisms affording vertical adjustment of the backboard have been commonly used, some with screw drives to effect the desired adjustment. Screw drives require considerable torquing effort, require lubrication, tend to wear and need to be replaced when they become worn. The screw in such construction carries the full weight of the adjustable backboard and its attachments, thus accelerating wear.

BRIEF DESCRIPTION OF THE INVENTION

The vertically adjustable backboard assembly herein disclosed includes a fixed position structure and a vertically adjustable backboard structure supported on the fixed position structure. The fixed position structure includes a centrally positioned vertical rectangular section outer tube with a pair of vertically spaced horizontal beams rigidly secured at their mid sections to the outer tube near its top and bottom. The laterally outer ends of the beams have slide blocks with cylindrical openings rigidly secured thereto. The vertically adjustable structure includes a backboard, a rim, a pair of laterally spaced vertical guide rails rigidly secured to the backside of the backboard and an inner tube with a rim mounting plate on its lower end secured to a lower central part of the backboard. A cam operating rod is supported in the inner tube and includes a cam secured to its upper end and a combined torque and vertical thrust transmitting coupler at its lower end in the form of an eye rigidly secured thereto. The outer tube includes a series of vertically spaced openings which are individually engageable by the cam, upon rotation of the cam rod, to establish the desired height of the backboard. The vertically adjustable backboard assembly of this invention uses a torsion spring counterbalancing apparatus to counterbalance the weight of the backboard and parts secured thereto. In a preferred embodiment, a force balancing condition occurs when the backboard is near its mid point of vertical adjustment. When vertically adjusting the backboard a person uses a pivot and linear thrust tool in the form of a push pull pole with a connecter on its upper end to hook the eye on the lower end of the cam operating rod. Rotation of the rod in one direction engages the cam on its upper end in an aligned notch or slot in the vertically extending outer support tube of the fixed position structure. Rotating the rod in the opposite direction disengages the cam from the notch. The person then adjusts the adjustable backboard structure to a new vertical position using the push pull pole by first physically moving the counterbalanced backboard structure upward or downward to a desired height and next by rotating the cam operating rod to engage the cam in the newly selected opening in the outer support tube. The stationary support structure includes the before mentioned outer vertical support tube, a pair of vertically spaced horizontal upper and lower support beams rigidly secured at their midsection to the upper and lower ends of the outer support tube, vertically aligned slides secured to opposite ends of the beams and a torsion spring apparatus supported on the upper support beam and the upper end of the outer support tube. A support bracket is rigidly fixed to the rear midsection of each of the beams, the support brackets being adapted for connection to a rigid stationary vertically extending support. The vertically shiftable backboard structure includes a pair of laterally spaced vertical rails slidingly received in the slides. Each of the rails is rigidly secured to the backboard by vertically spaced upper and lower connectors or brackets. The rim supporting inner tube is telescopically fitted in to the outer tube with the rim mounting plate on its lower end connected to the central lower rear of the backboard and to the rim. A pair of laterally spaced support cables extend downward from the torsion spring counterbalancing apparatus and connect, respectively, at laterally spaced points to the upper brackets used to secured the rails to the backboard.

BRIEF DESCRIPTION OF THE DRAWINGS

A preferred embodiment of the invention is illustrated in the drawings, in which.

DETAILED DESCRIPTION OF THE INVENTION

Figure 1:
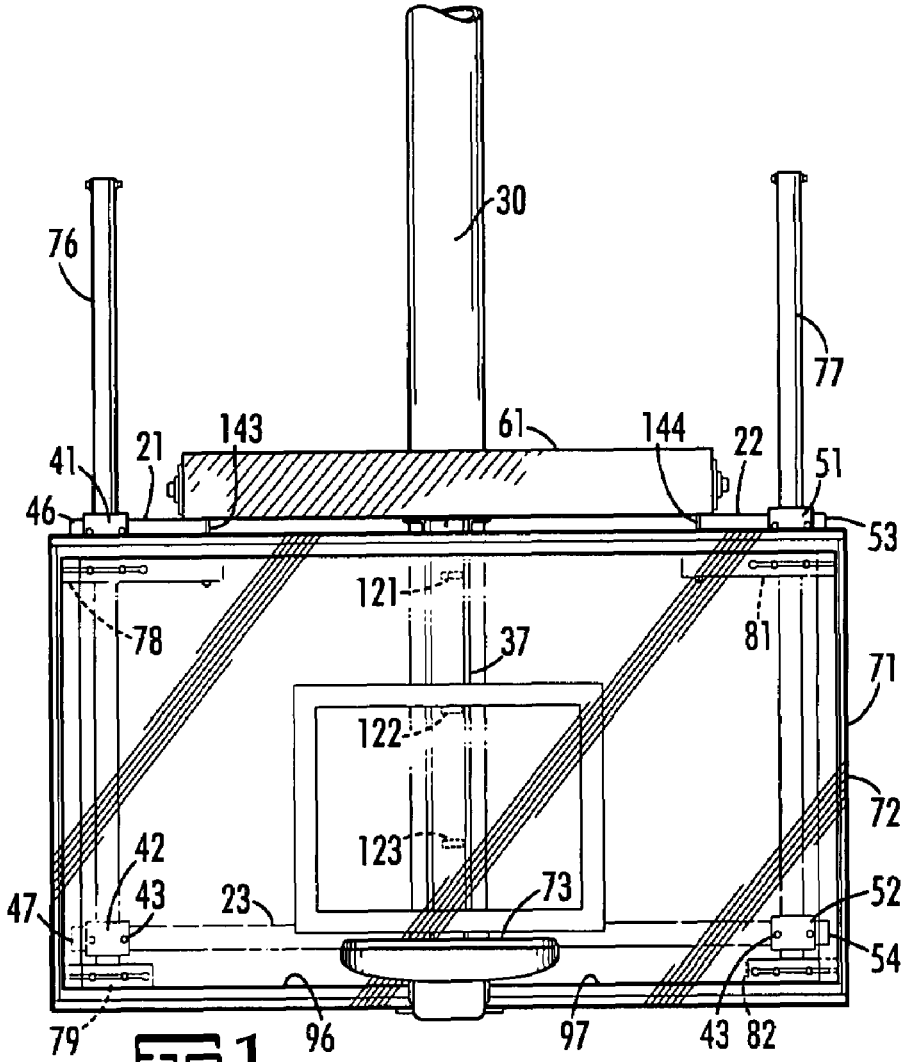
FIG. 1 is a front view of the adjustable backboard and support assembly installed on a rigid support.
Figure 2:
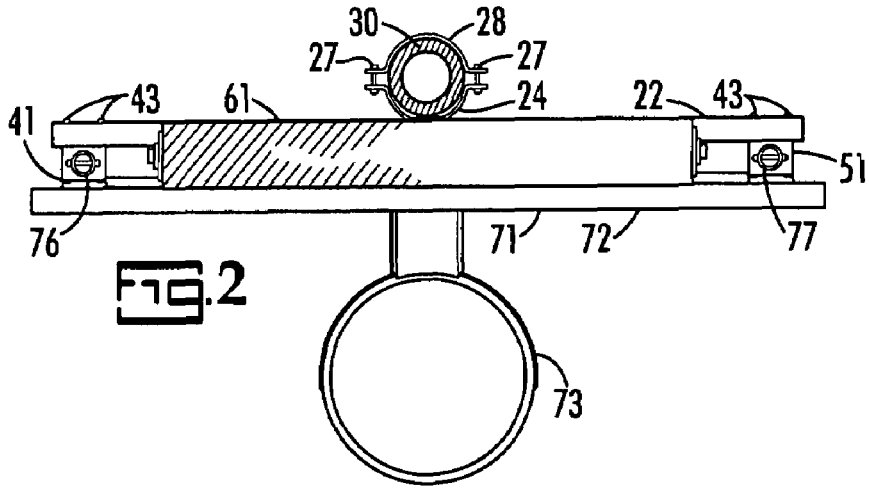
FIG. 2 is a top view of the structure shown in FIG. 1.
Figure 4:
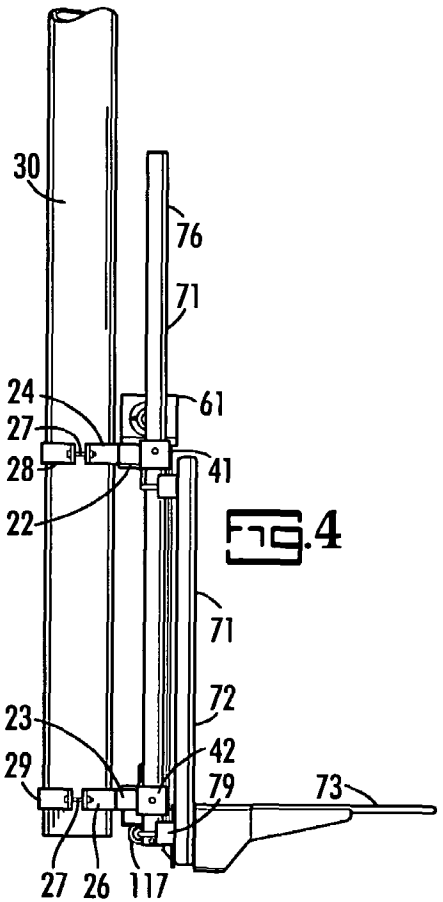
FIG. 4 is a side view of the backboard and support assembly shown in FIG. 1.

The drawings illustrate a support assembly for a vertically adjustable basketball backboard which includes a fixed position structure 21 adapted for attachment to a fixed support; which may, for instance, be a vertical metal tube extending downwardly from the ceiling trusses of a gymnasium facility, now shown. The fixed position structure 21 includes a pair of vertically spaced horizontal beams 22, 23 with semi-circular mounting brackets 24, 26 rigidly secured to the mid section of their respective rear sides. As illustrated, the fixed position structure 21 is rigidly secured to a downwardly extending six inch cylindrical pipe 30 by fasteners 27 securing semicircular retainers 28, 29 to the brackets 24, 26 thereby preventing relative movement between the support pipe 30 and the fixed position structure 21. The fixed position structure 21 also includes a vertical support member in the shape of rectangular section outer tube 37 rigidly secured adjacent its upper and lower ends as by welding to the upper and lower horizontally beams 22, 23, respectively. A first pair of slides 41, 42 are rigidly secured by fasteners 43 to first corresponded ends 46, 47, respectively, of the beams 22, 23, and a second pair of slides 51, 52 are rigidly secured to second corresponding ends 53, 54, respectively, of the beams 22, 23, by fasteners 43. A torsion spring counterbalancing assembly 61 is securely mounted on the top of the upper beam 22 and the outer tube 37.

Figure 3:
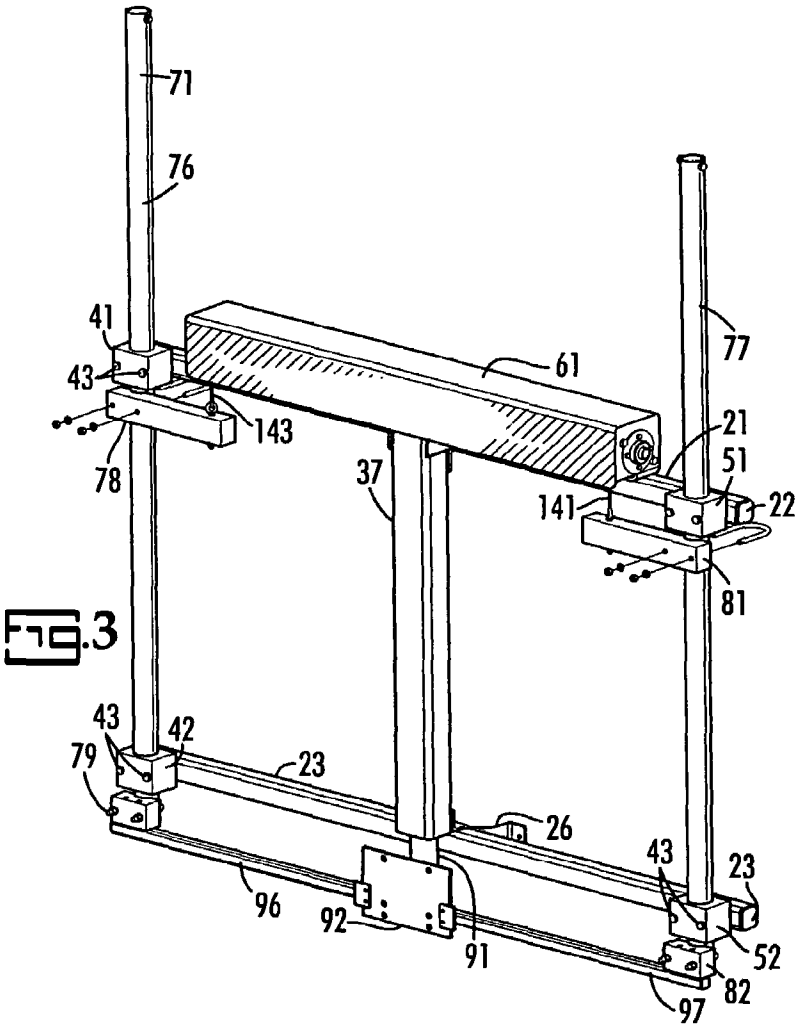
FIG. 3 is a perspective view of the adjustable backboard assembly shown in FIG. 1 removed from the rigid support and with the backboard and rim also removed.
Figure 5:
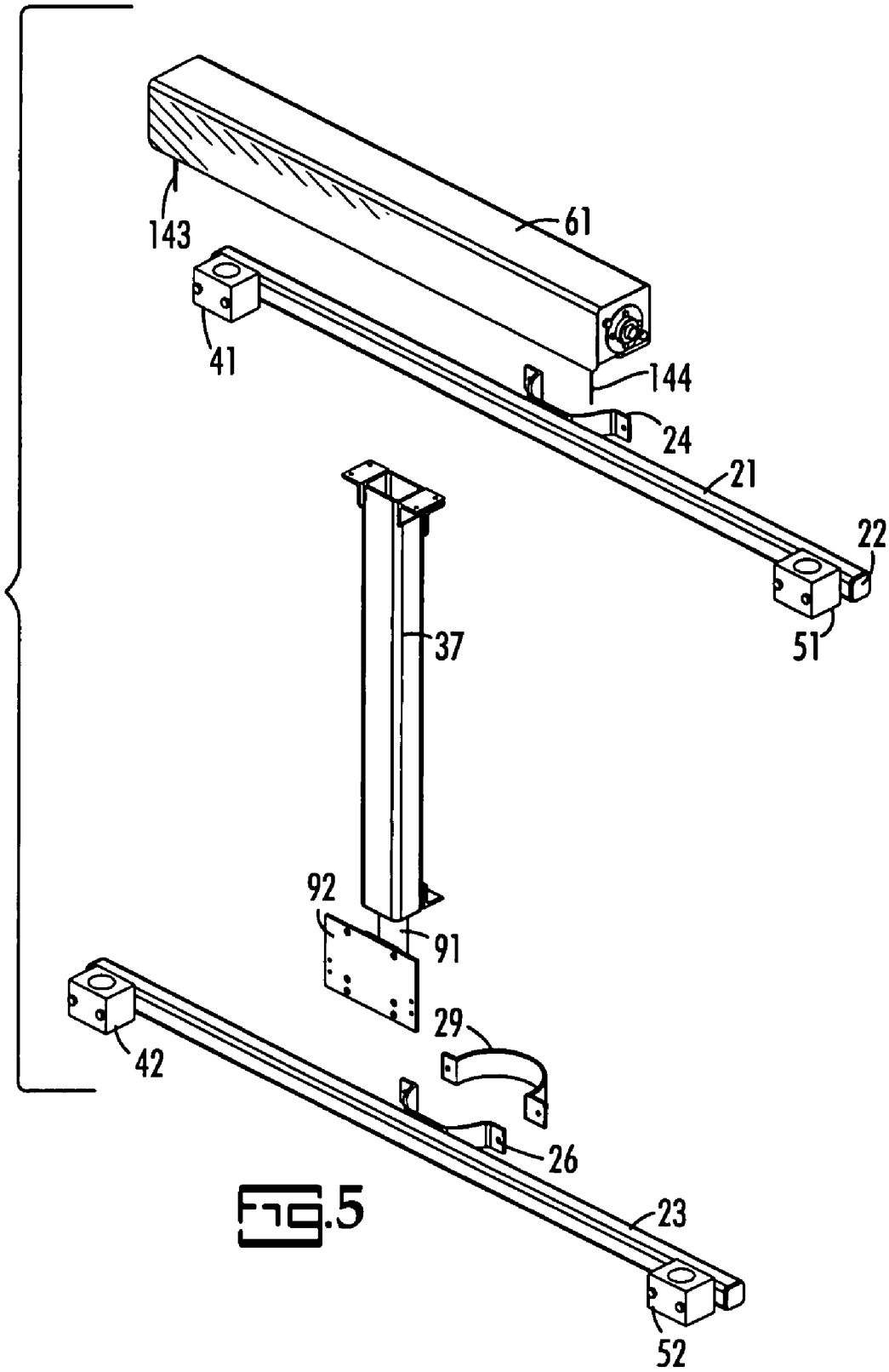
FIG. 5 is an exploded perspective view of the fixed position structure of the adjustable backboard assembly together with an inner tube adapted for connection to a backboard and a rim.
Figure 6:
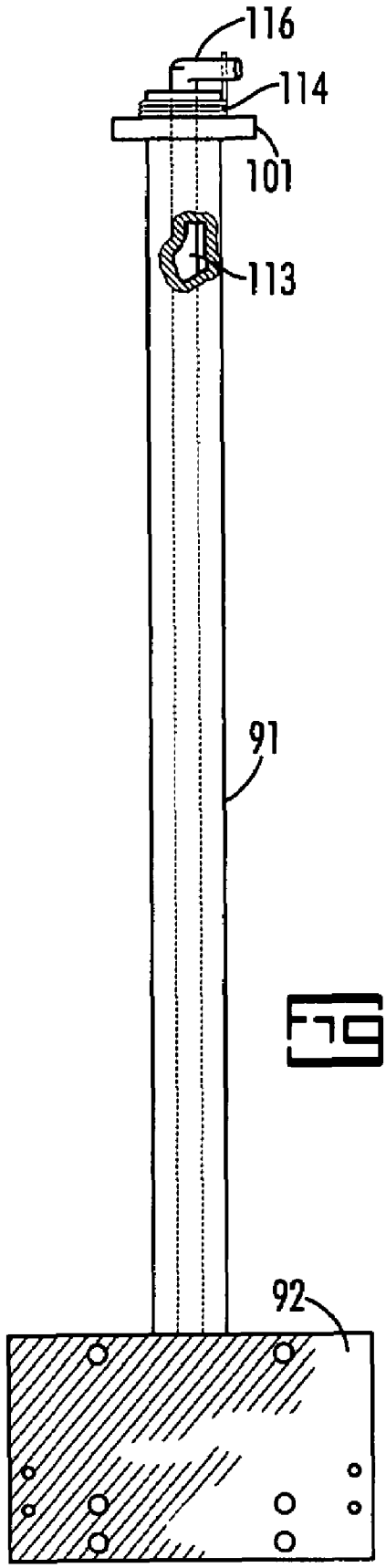
FIG. 6 is a front view of the inner tube.
Figure 10:
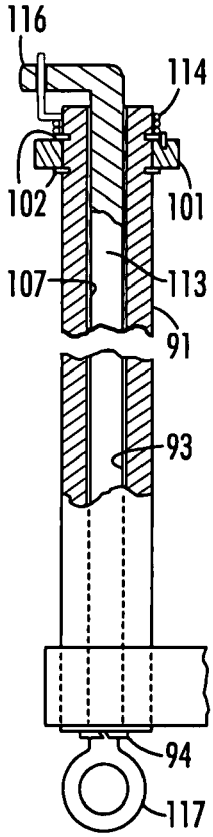
FIG. 10 is a partially sectioned view of the inner tube, cam and cam operating rod.
Figure 11:
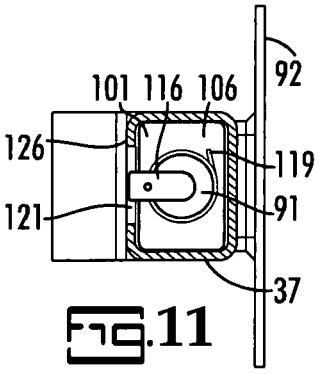
FIG. 11 is an enlarged section taken on line 13-13 in FIG. 8.
Figure 12:
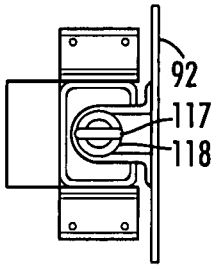
FIG. 12 is an enlarged bottom view of the assembled tubes shown in FIG. 8.

The vertically adjustable basketball backboard structure 71 includes a rectangular backboard 72, a rim 73, a pair of laterally spaced vertical cylindrical guide rails 76, 77 rigidly secured by brackets 78, 79, 81, 82 bolted to the rear of the backboard 72 near its four corners and an inner tube 91 which has a cylindrical interior surface 93 and a vertically disposed rim mounting plate 92 rigidly secured thereto adjacent to its lower end. As shown in FIG. 3, a pair of laterally extending horizontal struts 96, 97 have laterally inner ends secured to the rim mounting plate 92 and laterally outer ends rigidly secured, as by welding, to the brackets 79, 82 bolted to the backboard at its lower rear corners. The inner tube 91, as shown in FIGS. 6, 10 and 11, has a rectangular position collar or guide 101 connected near its upper end by snap rings 102 engaging annular grooves in the outer surface of the inner tube 91. The position collar 101 maintains the inner tube 91 in central alignment with the outer tube 37. A cam rod 113 is rotatably mounted in the cylindrical interior 107 of the tube inner 91 and extends above the upper end of the tube 91. A cam 116 is rigidly secured to, and extends radially from the upper end of rod 113. The cam rod 113 has a combined torque and axial thrust transmitting coupler 117 with a horizontal opening in the shape of an eye, the coupler being formed by welding an eye bolt to the lower end of the rod 113. A snap ring 94 mounted in an annular groove in the cam rod 113, near its lower end serves as an axial thrust bearing preventing upward axial movement of the rod 113 relative to the inner tube 91. A cam 116 rigidly secured to and extending radially from the upper end of the cam rod 113 prevents downward movement of the cam rod 113 relative to the inner tube 91. The cam rod 113 is rotationally biased in relation to the inner tube 91 toward a slot engaging position, as shown in FIG. 11, by a coil spring 114 coiled about the upper end of the inner tube 91 with opposite ends inserted into openings in the cam 116 and the position collar 101, respectfully.

Figure 15:
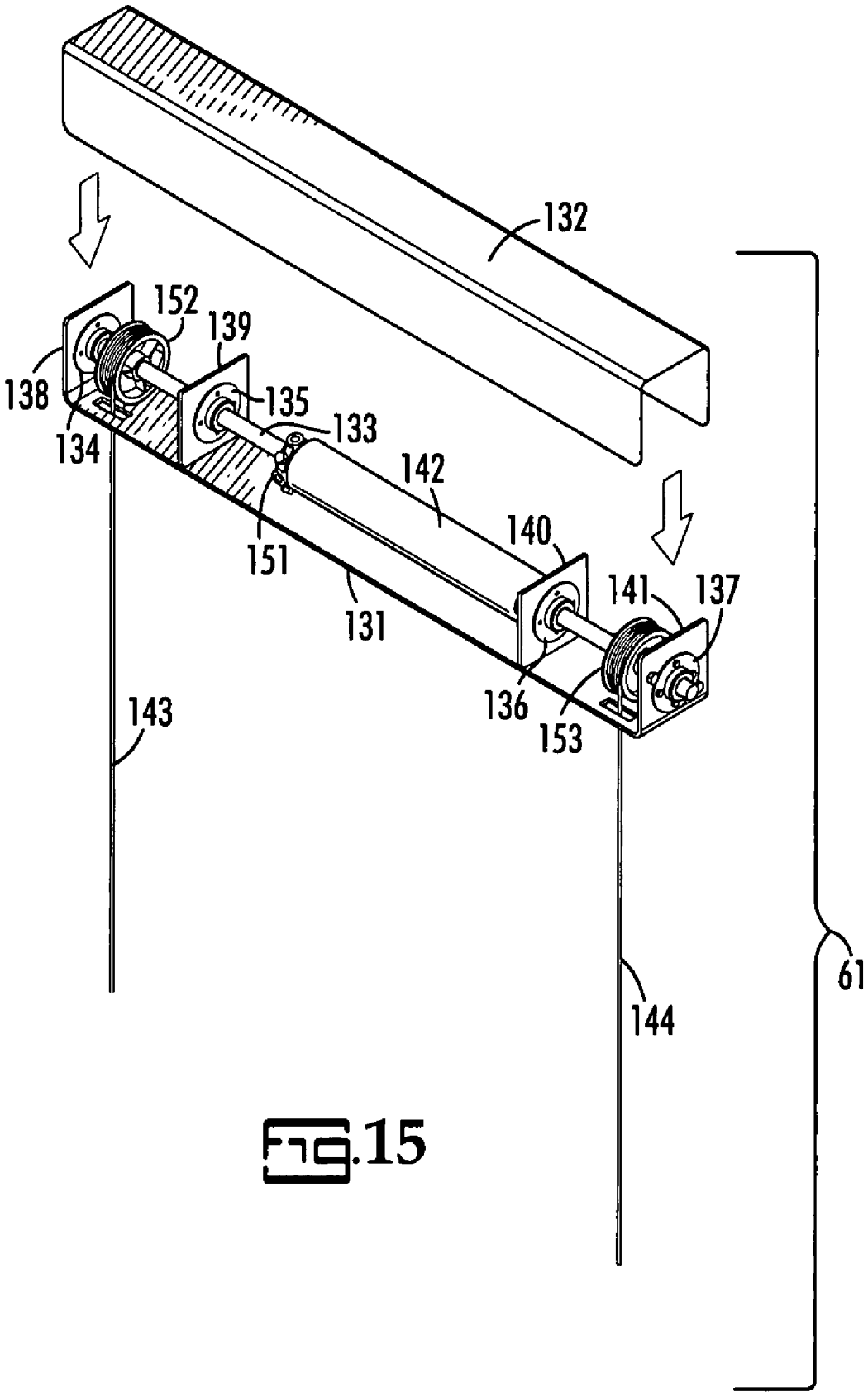
FIG. 15 is an exploded view of the counterbalancing mechanism.

When the vertically adjustable backboard structure 71 is vertically positioned to horizontally align the cam 106 with a selected one of three vertically spaced horizontal slots or openings 121, 122, 123 in the rear wall 126 of the outer tube 37, the cam rod 113 and its cam 116 may be rotated into the selected opening in the outer tube 37, thereby vertically positioning the backboard 72 at a selected height. As shown in FIG. 15, the counterbalance mechanism 61 includes a housing having a support frame 131 and a cover 132. The counterbalance mechanism 61 also includes a shaft 133 supported in aligned bearings 134, 135, 136, 137 mounted on vertical walls 138, 139, 140, 141, respectively, of the support frame 131 and a coil spring 142 having one end secured to the wall 140 and its other end secured to the shaft 133 through a tensioner 151. Cable drums 152, 153 nonrotatably secured to the shaft 133 have backboard support cables 143, 144 coiled thereon. As shown in FIG. 3, the lower ends of the cables 143, 144 are secured to the bracelets 78, 81 secured to the upper rear of the backboard 72 and apply equal counterbalancing force to the adjustable backboard support structure 71. The counterbalancing force applied through the spring biased cables 143, 144 can be adjusted by the tensioner 15 so as to be sufficient to elevate and maintain the adjustable backboard support structure 71 at a midpoint position in its range of vertical adjustments. In the midpoint position, the cam 116 is aligned with and is insertable in the central opening 122 in the outer tube 37.

Figure 7:
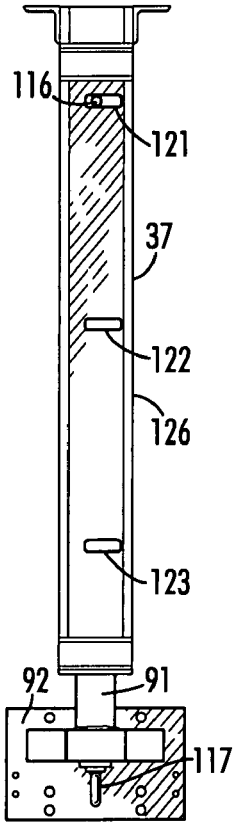
FIG. 7 is a rear view of the assembled inner and outer tubes.
Figure 8:
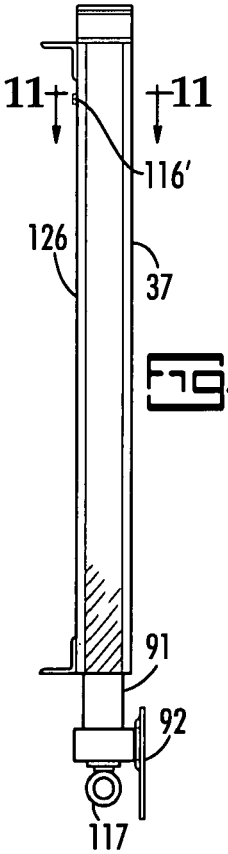
FIG. 8 is a side view of the tubes shown in FIG. 7.
Figure 9:
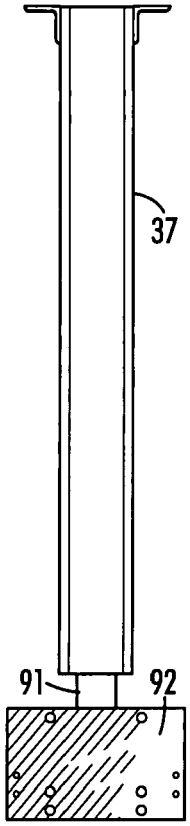
FIG. 9 is a front view of the tubes shown in FIGS. 7 and 8.
Figure 13:
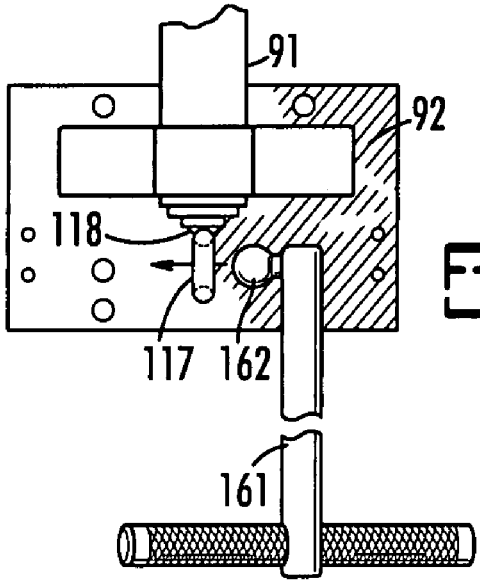
FIG. 13 is a partial rear view of the lower end of the inner tube showing the thrust end of a push pull tool poised for insertion into the eye of the cam rod.
Figure 14:
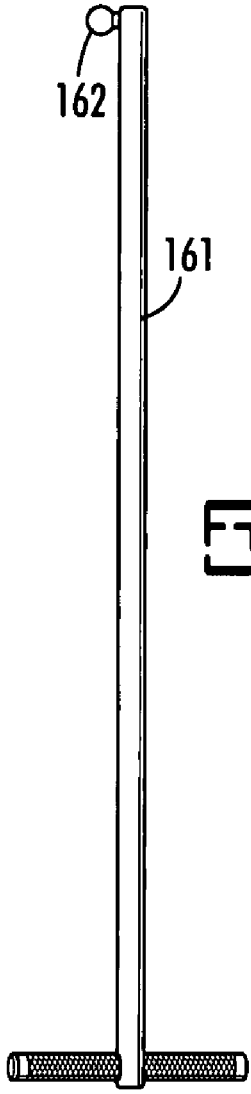
FIG. 14 is a side view of the push pull tool.

Rotation of the cam 116 and vertical adjustment of the backboard 72 is achieved by use of an elongated operating tool or pole 161, shown in FIGS. 13 and 14, which has a spherical shaped hook 162 extending radially from its upper end. The hook 162 is sized to pass through the eye or opening of the eye shaped coupler 117. As shown in FIGS. 7, 8 and 11, the cam 116 has been inserted into the opening 121. The cam 116 is resiliently biased toward its locking or latching position shown in FIG. 11 by the coil tension spring 114 interconnected between the cam 116 and the position collar 101. Thus the cam 116 is prevented from drifting out of the engagement with a selected opening. Vertical adjustment of the counterbalanced backboard from its central balanced position to its top or bottom position is easily achieved by manually pushing or pulling on the pole 161 with the hook 162 engaged in the eye of the coupler 117.

Figure 16:
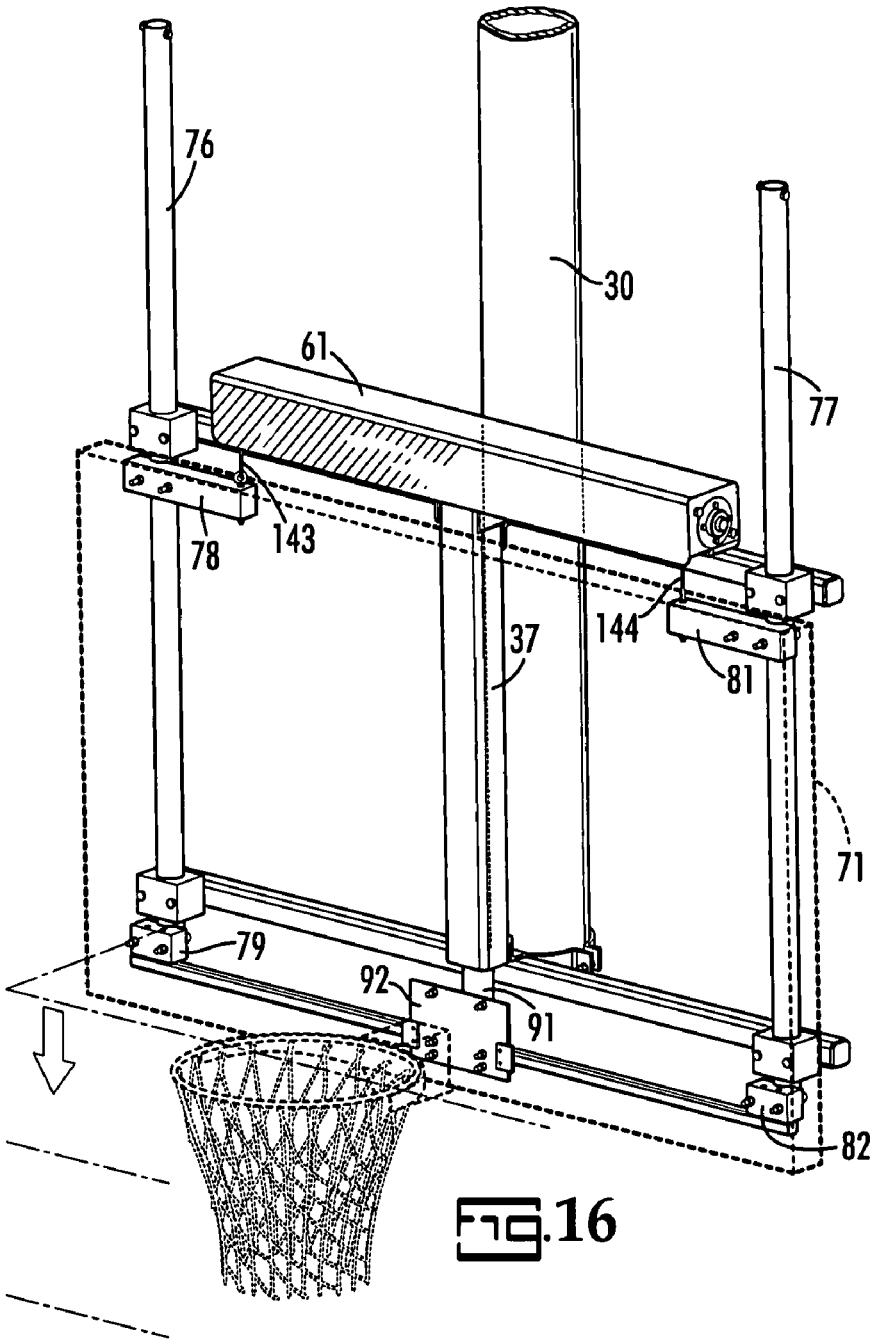
FIG. 16 is a perspective view of the vertically adjustable backboard structure in its highest position of vertical adjustment and the backboard and rim shown in broken lines for illustration purposes.
Figure 17:
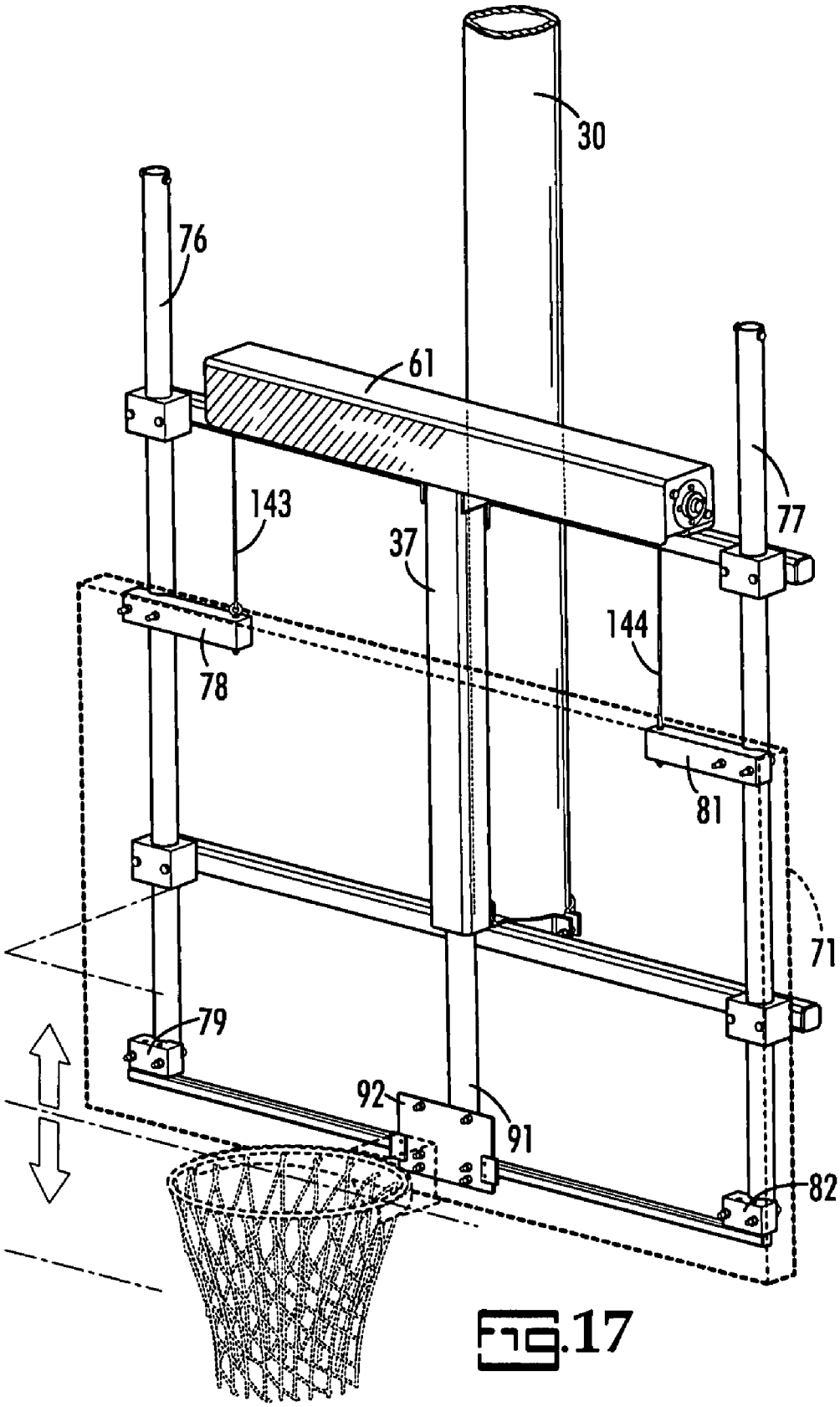
FIG. 17 is a view similar to FIG. 16 showing the adjustable backboard structure in its middle position of vertical adjustment.
Figure 18:
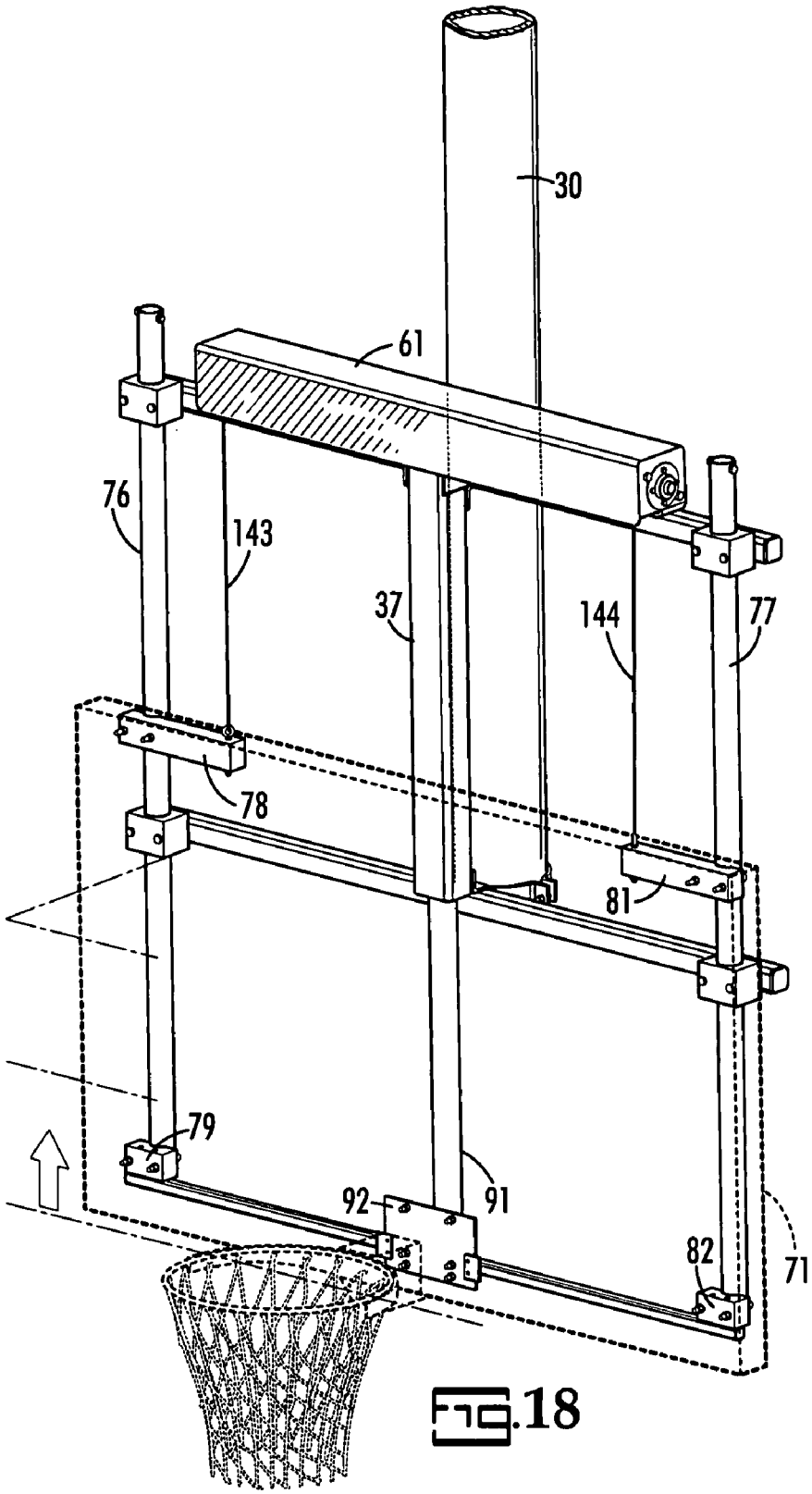
FIG. 18 is a view similar to FIGS. 16 and 17 showing the backboard structure in its lowest position of vertical adjustment.

FIG. 16 shows the backboard structure 71 adjusted to its highest position in which event the cam 116 engages the opening 121. FIG. 17 shows the backboard structure 71 adjusted to its intermediate position wherein the cam 116 engages the opening 122 and the FIG. 18 shows the backboard structure 71 adjusted to its lowest position with the cam 116 engaging the opening 123 in the outer tube 37.

The herein illustrated and described adjustable backboard assembly utilizes torsion spring counterbalancing of the vertically adjustable backboard structure which permits direct manual force to be used to quickly and easily move the backboard between three different vertical positions. A drive mechanism is not needed to change the height of the backboard to facilitate use of the court by different groups of players, such as players of different age groups.

What is claimed is:

1. A vertically adjustable basketball backboard support assembly comprising:

a pair of vertically spaced horizontally extending parallel upper and lower beams having first and second corresponding ends, vertically spaced upper and lower support brackets rigidly secured, respectively, to said upper and lower beams, said support brackets being adapted for connection to a fixed position vertical support, a rectangular vertical basketball backboard having a front and a rear, a pair of parallel laterally spaced vertical guide rails rigidly secured to said rear of said backboard, a first pair of slides rigidly secured, respectfully, to said first corresponding ends of said beams and slidingly connected to one of said vertical guide rails, a second pair of slides rigidly secured, respectively, to said second corresponding ends of said beams and slidingly connected to the other of said guide rails, a rigid rectangular section vertically extending outer tube rigidly secured near its opposite ends to said beams midway between their ends, said outer tube having a plurality of vertically spaced horizontally elongated slots and an open lower end, an inner tube slidingly positioned within said outer tube for vertical telescopic movement relative thereto having a lower portion to which a horizontally facing rim support plate is rigidly secured, said inner tube having a cylindrical interior with openings at its upper and lower ends, a cam control rod journaled in said cylindrical interior of said inner tube with an upper end extending above said upper end of said inner tube including a cam rigidly secured to and extending radially from said upper end of said cam control rod, said cam being selectively engageable with said slots upon manual movement of said inner tube to align said cam with a selected slot and upon rotation of said cam by rotation of said rod, a pivot tool receptacle rigidly secured to said lower end of said control rod; and a torsion spring counterbalance mechanism mounted on said upper support member including a pair of laterally spaced cable pulleys with cables connected, respectively, to laterally spaced points of said backboard.

2. The support assembly of claim 1 wherein said counterbalance mechanism counterbalances the weight of said backboard, said rails and said inner tube.

3. The support assembly of claim 2 wherein said counterbalancing occurs when said backboard is positioned at the midpoint of its vertical adjustment.

4. The support assembly of claim 1 wherein said counterbalance mechanism includes a coil spring.

5. The support assembly of claim 1 including at least one axial thrust bearing between said inner tube and said control rod preventing upward axial shifting of said control rod relative to said inner tube.

6. The support assembly of claim 1 wherein said pivot tool receptacle includes a horizontal opening.

7. The support assembly of claim 1 including a position collar on the upper end of said inner tube maintaining said inner tube in alignment with said outer tube.

8. The support assembly of claim 1 wherein said cables are connected to said backboard near its upper end.

9. The support assembly of claim 1 having a basketball rim rigidly secured to said rim support plate.

10. The support assembly of claim 1 wherein each of said rails is rigidly secured to upper and lower rear portions of said backboard.

11. A vertically adjustable basketball backboard support assembly comprising:

a fixed position structure including a vertically disposed rectangular section outer tube having a front wall, a rear wall, a pair of laterally opposite side walls, an upper end, an open lower end and a plurality of vertically spaced openings in one of said walls, an upper horizontally disposed beam rigidly secured at its longitudinal mid section to said rear wall of said outer tube adjacent its upper end, a lower horizontally disposed beam rigidly secured at its longitudinal mid section to said rear wall of said outer tube adjacent its lower end, said beams having first and second corresponding ends, a first pair of vertically aligned slides rigidly secured to said first corresponding ends of said beams, and a second pair of vertically aligned slides rigidly secured to said second corresponding ends of said beams, a torsion spring counterbalancing assembly mounted on said upper beam including a pair of laterally spaced spring biased depending cables, a vertically shiftable structure including a vertically disposed basketball backboard an inner tube telescopically positioned in said outer tube including, a cylindrical interior, an upper end, and a lower end, a vertically extending cam rod pivotally mounted in said cylindrical interior of said inner tube and having upper and lower ends, a cam rigidly secured to and extending radially from said upper end of said cam rod, a combined torque and axial thrust transmitting coupler secured to said lower end of said cam rod, and a rim mounting plate secured to said inner tube near its lower end, said rim mounting plate being secured to and engaging the back of said backboard, a first and second parallel vertical rails rigidly secured to said backboard and slidingly mounted in said first and second pairs of slides, respectively, said depending cables of said torsion spring assembly having lower ends connected, respectively, to said backboard.

12. The support assembly of claim 11 including spring tensioning apparatus, operatively associated with said torsion spring counterbalancing assembly operable to tension said cables.

13. The support assembly of claim 11 wherein said torsion spring counterbalance assembly supports said vertically shiftable structure in a balanced condition at a medium position of its vertical adjustment.

14. A vertically adjustable basketball backboard support assembly comprising:

a rigid vertically extending quadrilateral section outer tube having front, rear and laterally opposite side walls, an open lower end and an upper end, a pair of vertically spaced horizontally extending parallel upper and lower beams having first and second corresponding lateral ends, said beams being rigidly connected at their respective mid sections to said outer tube near the latter's upper and lower ends, respectively, vertically spaced upper and lower support brackets rigidly secured, respectively, to said mid sections of said upper and lower beams, said brackets being adapted for connection to a rigid vertically extending support, a torsion spring counterbalance assembly secured to said upper beam including a pair of laterally spaced downwardly extending backboard support cables with lower ends, a rigid inner tube telescopically fitted within said outer tube for vertical movement relative thereto having a cylindrical interior and a lower portion extending from said lower end of said outer tube, said lower portion including a rigidly secured front facing rim support plate, a vertically disposed basketball backboard and rim rigidly secured to said rim mounting plate, connecters securing said lower ends of said cables to said backboard near its upper end and a pair of laterally spaced guide structures interconnecting the laterally outer ends of said beams and said backboard whereby said backboard is vertically guided relative to said beams wherein said support assembly having a plurality of vertically spaced cam receiving openings in one of said walls of said outer tube, a vertically extending cam control rod journaled in said inner tube a vertical axis and having a cam rigidly secured to and extending radially from the upper end of said rod, said cam being selectively engageable with said openings upon vertical adjustment of said inner tube to align said cam with an opening and rotation of said cam control rod and a pivot tool receptacle rigidly secured to the lower end of said cam control rod.

15. The support assembly of claim 14 wherein each of said guide structures includes a vertically extending guide rail and a pair of vertically spaced aligned slides slidingly connected to said guide rail.

16. The support assembly of claim 15 wherein said guide rails are rigidly secured to said backboard and said slides are rigidly secured to said beams.

* * * * *